US005934080A

United States Patent [19]

Foley et al.

[11] Patent Number: 5,934,080

[45] Date of Patent: Aug. 10, 1999

[54] FOG GENERATION USING LIQUID SYNTHETIC AIR

[75] Inventors: James F. Foley, Murrieta; Charles E. Converse, Victorville; F. Edward Gardner, Rialto; Mark Plant, Hermosa Beach, all of Calif.

[73] Assignee: Praxair Technology, Inc., Danbury, Conn.

[21] Appl. No.: 08/932,051

[22] Filed: Sep. 17, 1997

[51] Int. Cl.[6] ..... F17C 13/08

[52] U.S. Cl. ..... 62/46.1; 62/52.1; 62/53.2

[58] Field of Search ..... 62/46.1, 53.2, 62/52.1

[56] References Cited

U.S. PATENT DOCUMENTS

| | | | |
|---|---|---|---|
| 1,665,267 | 4/1928 | Jernberg | 239/2.1 X |
| 3,141,615 | 7/1964 | Waldron, Jr. | 239/8 |
| 3,788,825 | 1/1974 | Arenson | 62/52.1 |
| 4,698,976 | 10/1987 | Fieseler | 62/46.1 |
| 5,156,333 | 10/1992 | Worsfold | 239/2.1 |
| 5,327,732 | 7/1994 | De Almeida | 62/53.2 X |
| 5,548,961 | 8/1996 | Luger et al. | 62/52.1 X |
| 5,571,231 | 11/1996 | Lee | 62/48.2 |
| 5,711,481 | 1/1998 | MacDonald et al. | 62/52.1 X |
| 5,729,983 | 3/1998 | Garrett et al. | 62/46.1 |

FOREIGN PATENT DOCUMENTS

| | | |
|---|---|---|
| 657107 | 6/1995 | European Pat. Off. . |
| 774634 | 5/1997 | European Pat. Off. . |

OTHER PUBLICATIONS

"Liquid Synthetic Air Saves Batman and Robin", Praxair News (1977).

"The Air that I Breathe", Process Engineering (1977).

*Primary Examiner*—Christopher B. Kilner

*Attorney, Agent, or Firm*—Blake T. Biederman

[57] ABSTRACT

A process of generating fog by providing a transport vessel, loading predetermined quantities of liquid oxygen and liquid nitrogen into the transport vessel, and subjecting the transport vessel to a plurality of accelerations and decelerations to achieve a homogeneous mixture of the liquid oxygen and liquid nitrogen. The homogeneous mixture is delivered to a fog generator and fog is produced therefrom.

7 Claims, 1 Drawing Sheet

FOG GENERATION USING LIQUID SYNTHETIC AIR

FIELD OF THE INVENTION

This invention relates to the generation of fog as a special effect and more particularly to using liquid synthetic air and steam to generate fog.

BACKGROUND OF THE INVENTION

The entertainment industry uses fog as a special effect in a number of situations, especially during movie productions. Typically, liquid nitrogen or solid carbon dioxide is heated upon demand, such as by combining the nitrogen with steam in a fog generator. However, both of these cryogenic substances will degrade the surrounding atmosphere, eventually below safe limits if prompt mitigating action is not taken. Fog generators on movie production sets usually are accompanied by large fans which are periodically turned on, after the fog generators are turned off, to sweep away the accumulated nitrogen or carbon dioxide to protect actors and support personnel.

Because such conventional fogs present breathing hazards, their use during movie productions must be minimized. Photographers must estimate filming characteristics of a scene, and then adjust settings quickly after the fog generators are activated. More than one film take is generally required for each filming event which greatly increases personnel costs and efforts. The sweep fans must be utilized between takes to circulate fresh air over the scene which wastes further time and energy.

Synthetic liquid air has been manufactured and used to store perishable food stuffs such as disclosed in EP657107 (Garrett et al.) and EP774634 (Paige). Storage of multi-component cryogenic liquid is described in U.S. Pat. No. 5,571,231 (Lee). Use of synthetic liquid air as a chilling fluid for refrigeration is further discussed in an article entitled "The Air that I Breathe" (1997).

It is also known to produce synthetic liquid air for downhole injection at oil fields by adding liquid oxygen and then liquid nitrogen into a transport tractor trailer and driving the trailer around a yard to mix the load. Fifteen sudden stops from low speed is recommended to mix the liquids sufficiently for downhole injection and combustion purposes.

OBJECTS OF THE INVENTION

It is therefore an object of the invention to provide an improved fog generation method which produces breathable fog.

It is a further object of this invention to provide such a fog generation method which is safe for indoor use.

Yet another object of this invention is to provide such a method which enables photographers to optimize lighting and camera settings for each scene without time constraints.

A still further object of this invention is to reduce downtime between filming events.

Another object of this invention is to enable production of small volumes of liquid synthetic air at reasonable production costs.

SUMMARY OF THE INVENTION

This invention comprises a process of generating fog by providing a transport vessel, loading a predetermined quantity of liquid oxygen into the transport vessel, loading a predetermined larger quantity of liquid nitrogen into the transport vessel, and subjecting the transport vessel to a plurality of accelerations and decelerations to achieve a homogeneous mixture of the liquid oxygen and liquid nitrogen. The homogeneous mixture is delivered to a fog generator and fog is produced therefrom.

In a preferred embodiment fog is produced having a gaseous oxygen content of about 19.5 to about 22 percent by volume and the homogeneous mixture contains about 17.4 to about 20.5 percent oxygen by volume if converted to gaseous state. More preferably, fog is produced having a gaseous oxygen content of about 20.8 percent by volume and the homogeneous mixture contains about 19.3 percent oxygen by volume if converted to gaseous state. The trailer is subjected to the equivalent of at least ten mixing cycles, each cycle including five reversals of direction at low speeds and transport over a distance of about one-third mile.

BRIEF DESCRIPTION OF THE DRAWING(S)

Other objects, features and advantages will occur to those skilled in the art from the following description of (a) preferred embodiment(s) and the accompanying drawing(s), in which.

DETAILED DESCRIPTION OF THE INVENTION

Figure 1:
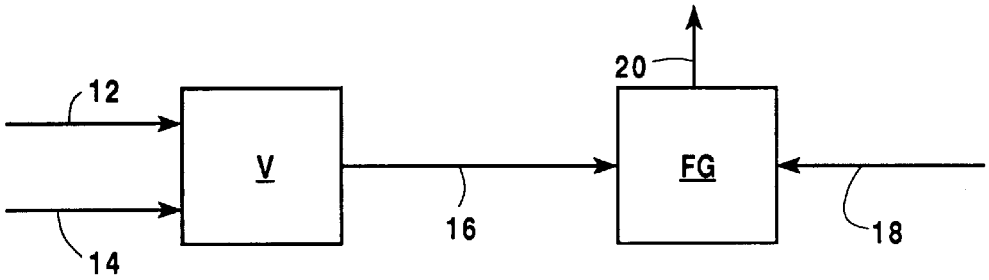
FIG. 1 is a process flow diagram of an embodiment of the invention.

This invention may be accomplished by generating fog using liquid synthetic air that is both mixed in and delivered by a transport vessel. A process according to the present invention is shown schematically in FIG. 1 including loading a predetermined quantity of liquid oxygen 12 into the transport vessel V, and loading a predetermined larger quantity of liquid nitrogen 14 into the transport vessel. The transport vessel is subjected to a plurality of accelerations and decelerations to achieve a homogeneous mixture 16 of the liquid oxygen and liquid nitrogen. The homogeneous mixture 16 is delivered to a fog generator FG as liquid synthetic air, preferably heated such as by interaction with steam 18, and fog 20 is produced therefrom.

Figure 2:
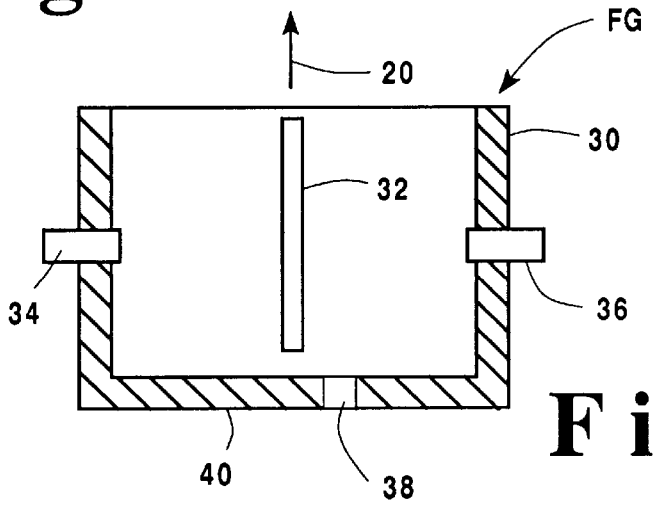
FIG. 2 is a schematic diagram of a fog generator using liquid synthetic air according to the present invention.

Fog generator FG is shown in greater detail in FIG. 2 having outer chamber 30, divider plate 32, liquid synthetic air inlet 34, steam inlet 36, and drain 38 in floor 40. In one construction chamber 30 is the lower portion of a fifty-five gallon drum, and plate 32 is suspended approximately one-half inch above floor 40 and four inches below the top of chamber 30.

The ratio of steam to liquid synthetic air preferably establishes the temperature of the mixture to be below the dew point of the surrounding atmosphere. The steam provides large quantities of moisture which results in a dense fog, and the synthetic air provides sufficient oxygen to sustain human life while avoiding increased fire hazard around potential ignition sources such as studio lights and camera positioning motors.

In another construction, the fog generator is a pipe with a plurality of holes or nozzles, and liquid synthetic air is delivered through the pipe into the ambient atmosphere. In this construction moisture is supplied by the ambient atmosphere to generate fog when the ambient temperature is lowered by the liquid synthetic air below the dew point of the atmosphere.

In a preferred embodiment fog 20 is produced having a gaseous oxygen content of about 19.5 to about 22 percent by volume and the homogeneous mixture contains about 17.4 to about 20.5 percent oxygen by volume if converted to gaseous state. More preferably, fog is produced having a gaseous oxygen content of about 20.8 percent by volume and the homogeneous mixture contains about 19.3 percent oxygen by volume if converted to gaseous state.

Figure 3:
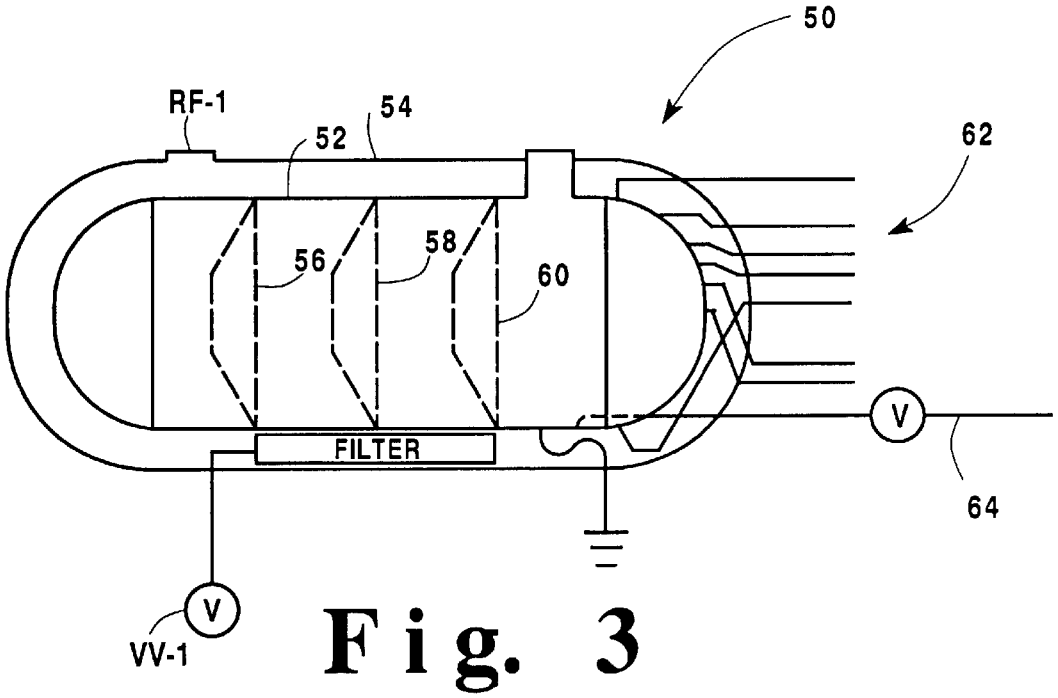
FIG. 3 is a schematic diagram of a trailer for mixing and transporting the liquid synthetic air.

One suitable transport vessel is shown in FIG. 3 as conventional oxygen tractor trailer 50 having inner vessel 52 and outer shell 54. Air in the space within shell 54 is evacuated through vacuum valve VV–1 to assist retention of cryogenic temperatures within vessel 52. Anti-surge baffles 56, 58 and 60 are frustoconical barriers with a plurality of liquid mixing openings in lower regions, service access openings in their centers, and gas vent openings in upper regions. The baffles are designed to minimize liquid surges during transportation to reduce potentially hazardous load shifts. However, the baffles greatly retard mixing of multi-component mixtures, and therefore active mixing according to the present invention must be conducted as described in more detail below.

Trailer 50 further includes a plurality of lines 62 for liquid and gas phase filling, venting, and monitoring. Liquid oxygen and then liquid nitrogen, preferably but not necessarily in that order, are delivered to vessel 52 through tricock fill line 64.

One example of achieving desired oxygen and nitrogen weights to be used in filling the vessel to provide 600,000 scf (standard cubic feet) of synthetic air having 19.3% oxygen in the gaseous state. 115,800 scf of oxygen and 484,200 scf of nitrogen are required. At 12.08 scf/lb, 9,586 lbs of liquid oxygen is added to the vessel then, at 13.80 scf/lb, 35,087 lbs of liquid nitrogen is added.

Pockets of oxygen and nitrogen generally are present in the vessel immediately after filling, and the baffles restrict mixing during transport. The trailer 50 therefore is subjected to the equivalent of at least ten mixing cycles to achieve a homogeneous mixture of liquid synthetic air, each cycle including five reversals of direction at low speeds and transport over a distance of about one-third mile. One equivalent to the ten mixing cycles is driving at least five miles in stop-and-go traffic, and another is driving approximately fifty miles from Fontana, California to Hollywood, such as to the Warner Bros' studio.

The homogeneous liquid synthetic air can be delivered directly to a fog generator or can be placed into a storage vessel. Because nitrogen boils off before oxygen, the mixture will become increasingly oxygen-rich over time. In a forty-five gallon dewar the 19.3% mixture produces fog having a desired oxygen content if used within four to five days, whereas in a 10,000 gallon storage vessel such a mixture will produce a desired fog if used within 10 days, with recirculation by pump for at least one-half hour per day in the storage vessel to maintain homogeneity.

Mixing of liquid oxygen and liquid nitrogen has been described above using a conventional oxygen tractor trailer. Through the use of orifice plates and constant liquid pressures one may achieve simultaneous filling of a vessel with both liquids and greatly enhance the rate of mixing.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A process of generating fog comprising: providing a transport vessel suitable for transporting liquid oxygen;

loading a predetermined quantity of liquid oxygen into said transport vessel;

loading a predetermined larger quantity of liquid nitrogen into said transport vessel;

subjecting said transport vessel to a plurality of accelerations and decelerations to achieve a homogeneous mixture of said liquid oxygen and liquid nitrogen; and delivering said homogeneous mixture to a fog generator and producing fog therefrom.

2. The process of claim 1 wherein fog is produced having a gaseous oxygen content of about 19.5 to about 22 percent by volume.

3. The process of claim 2 wherein said homogeneous mixture contains about 17.4 to about 20.5 percent oxygen by volume if converted to gaseous state.

4. The process of claim 1 wherein fog is produced having a gaseous oxygen content of about 20.8 percent by volume.

5. The process of claim 4 wherein said homogeneous mixture contains about 19.3 percent oxygen by volume if converted to gaseous state.

6. The process of claim 1 wherein said trailer is subjected to at least ten mixing cycles, each cycle including five reversals of direction at low speeds and transport over a distance of about one-third mile, or is subjected to an equivalent of said ten mixing cycles.

7. A process of generating fog comprising: providing a transport vessel suitable for transporting liquid oxygen;

loading a predetermined quantity of liquid oxygen into said transport vessel;

loading a predetermined larger quantity of liquid nitrogen into said transport vessel;

subjecting said transport vessel to at least ten mixing cycles, each cycle including five reversals of direction at low speeds and transport over a distance of about one-third mile, or subjecting said transport vessel to an equivalent of said ten mixing cycles, to achieve a homogeneous mixture of said liquid oxygen and liquid nitrogen, said homogeneous mixture containing about 19.3 percent oxygen by volume if converted to gaseous state; and delivering said homogeneous mixture to a fog generator and producing fog therefrom, said fog having a gaseous oxygen content of about 20.8 percent by volume.

* * * * *